US005516162A

United States Patent [19]

Takaishi

[11] Patent Number: 5,516,162

[45] Date of Patent: May 14, 1996

[54] HOOK-BOLT LOCK ASSEMBLY

[75] Inventor: Osamu Takaishi, Yamanashi, Japan

[73] Assignee: Takigen Manufacturing Co. Ltd., Tokyo, Japan

[21] Appl. No.: 521,014

[22] Filed: Aug. 30, 1995

Related U.S. Application Data

[63] Continuation of Ser. No. 191,804, Feb. 3, 1994, abandoned.

[30] Foreign Application Priority Data

Feb. 24, 1993 [JP] Japan ..... 5-012366 U

[51] Int. Cl.[6] ..... E05C 1/06

[52] U.S. Cl. ..... 292/37; 292/34

[58] Field of Search ..... 292/24, 27, 46, 292/49, 56, 109, 111, 124, 341.17

[56] References Cited

U.S. PATENT DOCUMENTS

| | | | |
|---|---|---|---|
| 352,627 | 11/1886 | Mix | 292/27 |
| 573,934 | 12/1896 | Trepte | 292/46 |
| 969,776 | 9/1910 | Foley | 292/49 |
| 1,264,814 | 4/1918 | Kornstein | 292/27 |
| 1,413,137 | 4/1922 | Sheinman | 292/46 |
| 1,464,456 | 8/1923 | Viehweger | 292/46 |
| 1,599,150 | 3/1925 | Taillefer | 292/27 |
| 1,662,907 | 6/1925 | Shilling | 292/49 |
| 2,664,734 | 1/1954 | McEneaney | 292/27 |
| 2,720,774 | 10/1955 | Gehrie | 292/27 |
| 3,582,119 | 1/1971 | Woodworth | 292/27 |

FOREIGN PATENT DOCUMENTS

| | | | |
|---|---|---|---|
| 106150 | 5/1938 | Australia | 292/46 |
| 1678017 | 12/1969 | Germany | 292/27 |
| 850830 | 5/1958 | United Kingdom | 292/27 |

*Primary Examiner*—Steven N. Meyers
*Assistant Examiner*—Gary Estremsky
*Attorney, Agent, or Firm*—Martin Smolowitz

[57] ABSTRACT

A hook-bolt lock assembly is improved in strength by hook-bolt plates (5, 6) and can be locked without inserting a key into a lock unit (22) when the assembly is locked, so as to be improved in operability. In the assembly: a movable plate (2) is biased by a spring (3) toward its projecting direction; the hook-bolt plates (5, 6) are pivoted to a casing (1); oblique cam surfaces (16, 17) of front-end hooks (9, 10), which abut on socket members (14, 15) of a stationary frame (13) when a door (12) is closed, are oriented outward in arrangement; a leaf spring (18) interposed between the plates biases them (5, 6) swingably outward; the movable plate (2) has cam projections (19, 20) abutting on outer edges (5*a*, 6*a*) of the plates. A rear end of a rotor (23) of the lock unit (22) fixed to the casing (1) is fixed to a base end of an operating-arm plate (24); and a front-end driving projection (25) of the plate (24) is inserted in a slot (26) of the movable plate (2).

2 Claims, 5 Drawing Sheets

HOOK-BOLT LOCK ASSEMBLY

This application is a continuation of application Ser. No. 08/191,804, filed Feb. 3, 1994, now abandoned.

BACKGROUND OF THE INVENTION

1. Field of the Invention

The present invention relates to a hook-bolt lock assembly for locking a door to a stationary frame element, in which a hook plate having its base-end portion pivoted to a casing has its front-end hook portion engaged with a socket member so that the door is locked to the stationary frame element.

2. Description of the Prior Art

In a conventional hook-bolt lock assembly, since only one hook-bolt plate is engaged with and disengaged from a socket member, the assembly is poor in mechanical strength. In addition, when the hook-bolt plate is swung from its engaging position toward its disengaging position, and vice versa, it is necessary for a user to insert a key into a rotor of a lock unit mounted on a front plate of a casing to have an operating arm rotated in a predetermined direction. However, such operation is cumbersome.

SUMMARY OF THE INVENTION

It is an object of the present invention to provide a hook-bolt lock assembly provided with a pair of hook-bolt plates which improve the assembly in mechanical strength, and eliminate the necessity of inserting a key into a lock unit when the assembly is locked, which improves the assembly in its operability. The object of the present invention is accomplished by providing:

a hook-bolt lock assembly comprising:

a movable plate which is slidably mounted in a casing and biased toward its projecting direction by a spring;

a pair of symmetrically-arranged hook-bolt plates having their base-end portions pivoted to an intermediate portion of a rear-surface plate of the casing through a pair of pivots, respectively;

the hook-bolt plates having their front-end hook portions projected outward from an end-surface opening portion of the casing, respectively;

the front-end hook portions which can abut against a pair of socket members of a stationary frame element when a door is closed, and have their oblique cam surfaces oriented outward, respectively;

a leaf spring interposed between the hook-bolt plates to swingably bias them outward;

the movable plate being provided with a pair of cam projections which abut against outer edge surfaces of he hook-bolt plates respectively; and a lock unit which is fixedly mounted on a front plate of the casing, and has a rear-end portion of its rotor fixed to a base-end portion of an operating-arm plate which has a driving projection of its front-end portion inserted into a slot of the movable plate.

DESCRIPTION OF THE PREFERRED EMBODIMENTS

Figure 1:
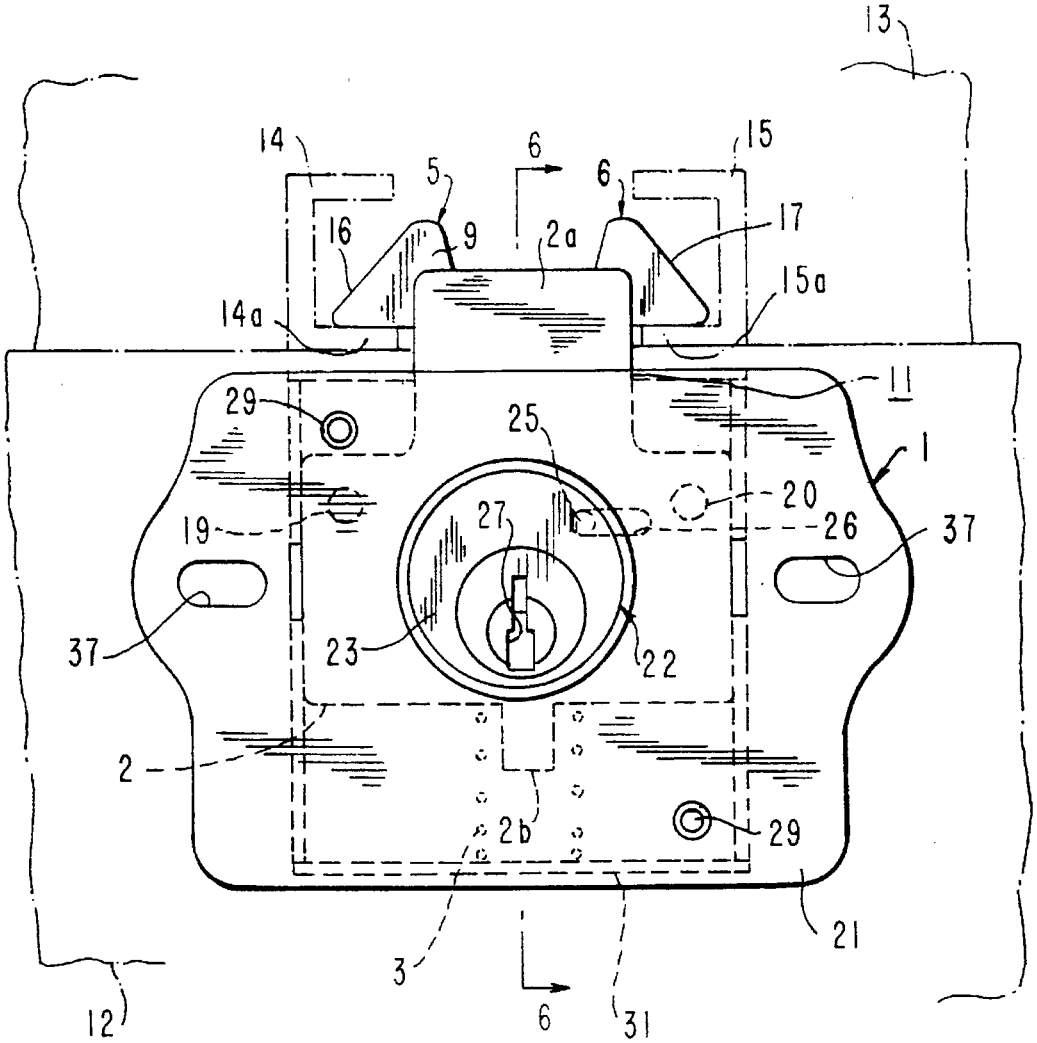
FIG. 1 is a front view of a door carrying an embodiment of the hook-bolt lock assembly of the present invention in its locked condition.

Hereinbelow, the present invention will be described in detail with reference to the accompanying drawings and the reference numerals and characters.

In a hook-bolt lock assembly of the present invention, a movable plate 2 is slidably mounted in a casing 1, and biased toward its projecting direction by a spring 3. A pair of hook-bolt plates 5 and 6 are horizontally arranged in the casing 1 in a symmetrical manner, and have their base-end portions pivoted to an intermediate portion of a rear-surface plate 4 of the casing 1 through a pair of pivots 7 and 8, respectively. Further, the hook-bolt plates 5 and 6 have their front-end hook portions 9 and 10 projected outward from an end-surface opening portion 11 of the casing 1, respectively. The front-end hook portions 9 and 10 abut against a pair of socket members 14 and 15 of a stationary frame element 13 when a door 12 is closed, and have their oblique cam surfaces 16 and 17 oriented outward, respectively.

A leaf spring 18 is interposed between the hook-bolt plates 5, 6 to swingably bias them outward. The movable plate 2 is provided with a pair of cam projections 19 and 20 which abut against outer edge surfaces 5*a* and 6*a* of the hook-bolt plate 5 and 6, respectively. A lock unit 22 is fixedly mounted on a front plate 21 of the casing 1, and has a rear-end portion of its rotor 23 fixed to a base-end portion of an operating-arm plate 24 which has a driving projection 25 of its front-end portion inserted into a slot 26 of the movable plate 2.

As shown in FIG. 1, in a condition in which the door 12 is locked to the stationary frame element 13, the pair of horizontally arranged hook-bolt plates 5 and 6 engage with the corresponding horizontally arranged pair of socket members 14 and 15, respectively. In this condition, the movable plate 2 is in its most projected position. On the other hand, the operating arm 24 is in its highest position and has its driving projection 25 engaged with an inner end portion of the slot 26 of the movable plate 2.

When the key 28 is inserted in a key hole 27 of the rotor 23 to rotate the rotor clockwise, the operating arm 24 is rotated to have its driving projection 25 moved in the slot 26 of the movable plate 2 and eventually abutted against the inner wall surface of the slot 26 of the movable plate 2 to push it. As a result, the movable plate 2 is retracted in the case 1 against a resilient force exerted by the spring 3. At this time, the cam projections 19 and 20 of the movable plate 2 push against the outer edge surfaces 5*a* and 6*a* of the hook-bolt plates 5 and 6, respectively.

Figure 7:
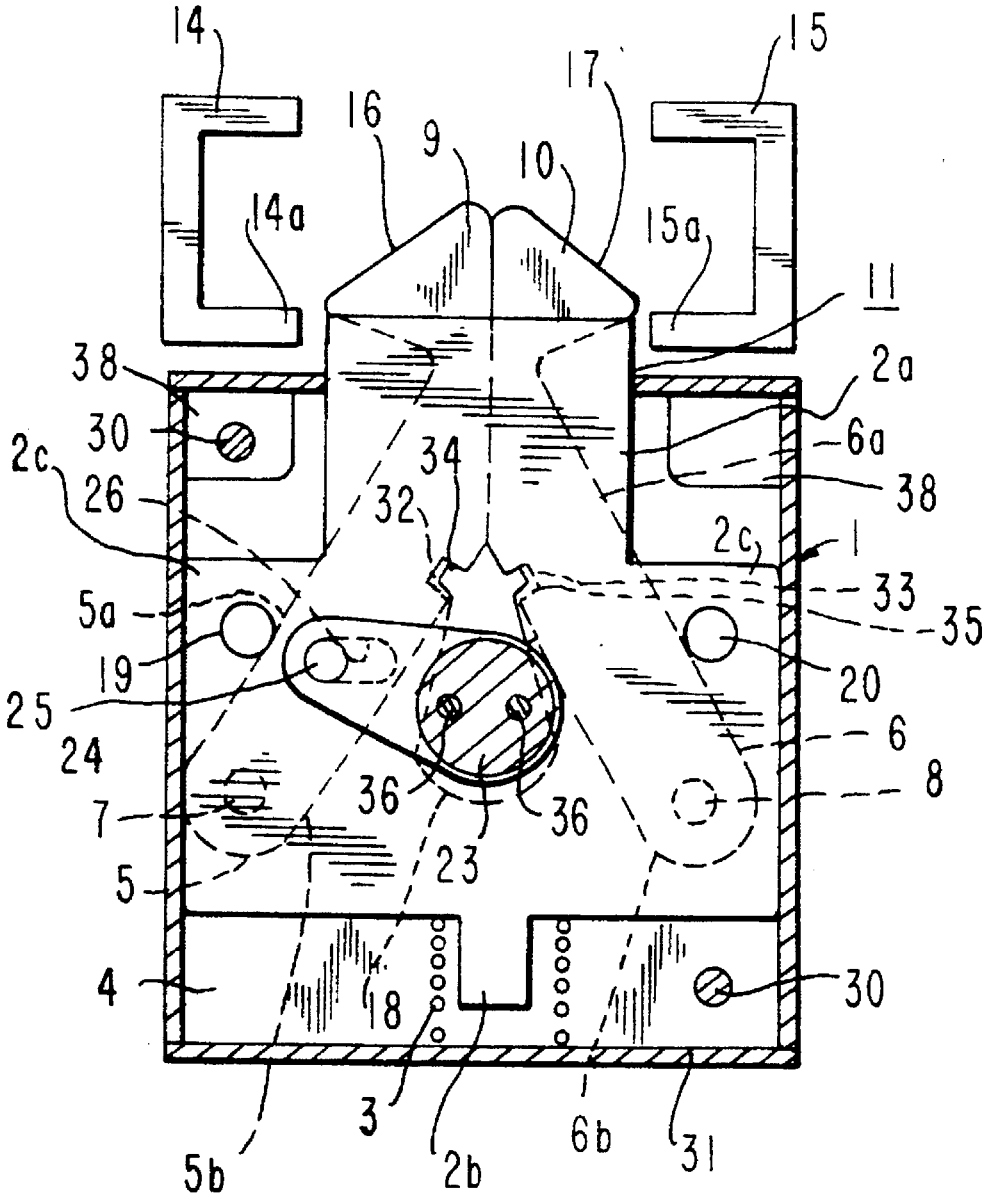
FIG. 7 is a sectional view of the hook-bolt lock assembly of the present invention, taken along the line 7—7 of FIG. 3, in a condition in which the hook-bolt lock assembly is unlocked.

Consequently, the hook-bolt plates 5, 6 are swung inwardly against a resilient force exerted by the leaf spring 18 to have their front-end hook portion 9, 10 abutted against each other back to back (see FIG. 7). In this stage of operation, the front-end hook portions 9 and 10 of the hook-bolt plates 5 and 6 are disengaged from the socket members 14 and 15, respectively. As a result, the door 12 is released from the stationary frame element 13 so that the user may open the door by pulling an appropriate handle means of the door forward.

Figure 2:
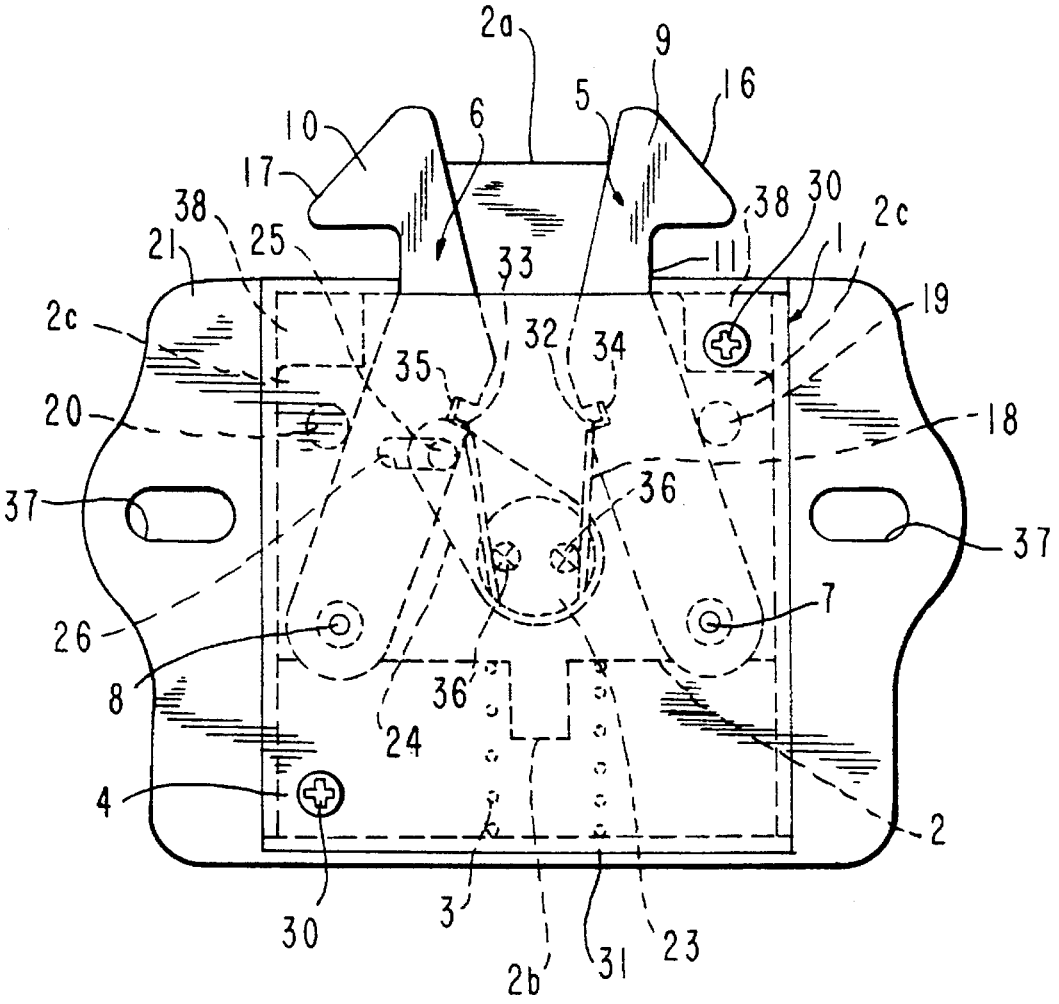
FIG. 2 is a rear view of the hook-bolt lock assembly of the present invention shown in FIG. 1.
Figure 3:
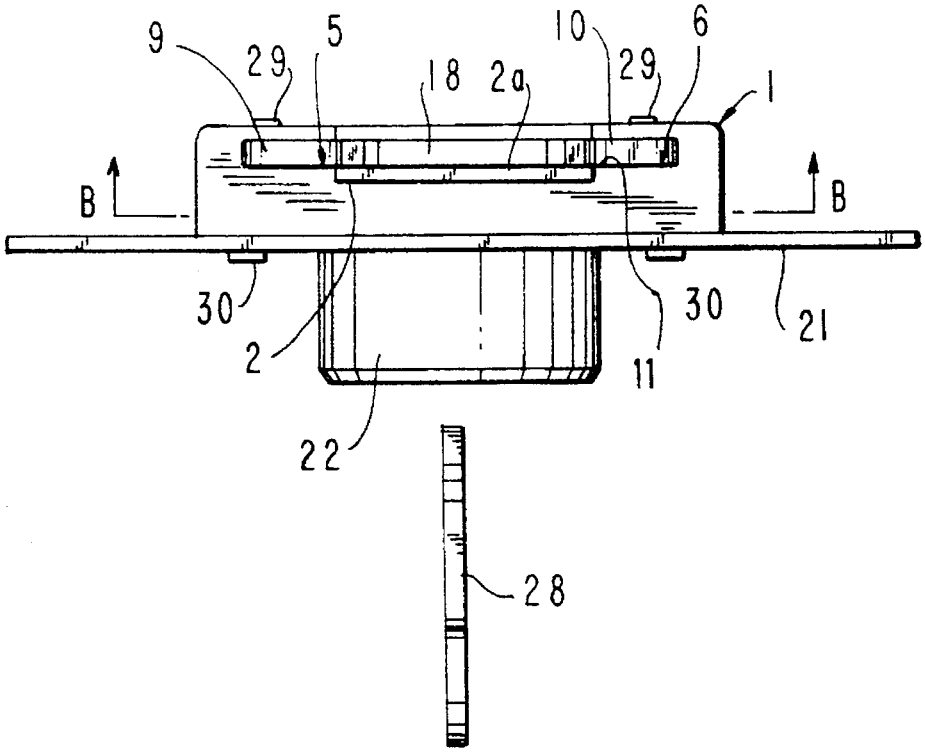
FIG. 3 is a plan view of the hook-bolt lock assembly of the present invention shown in FIG. 1.
Figure 4:
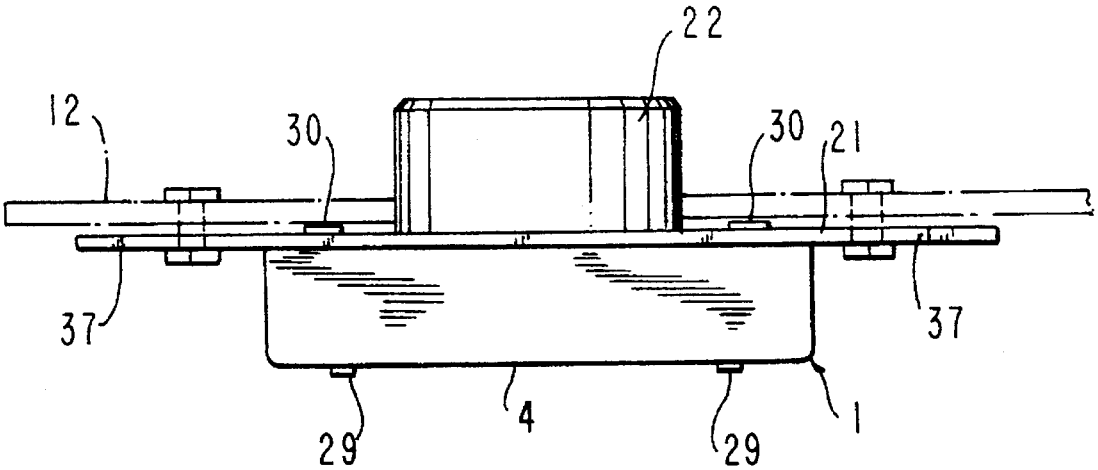
FIG. 4 is a bottom view of the hook-bolt lock assembly of the present invention.
Figure 5:
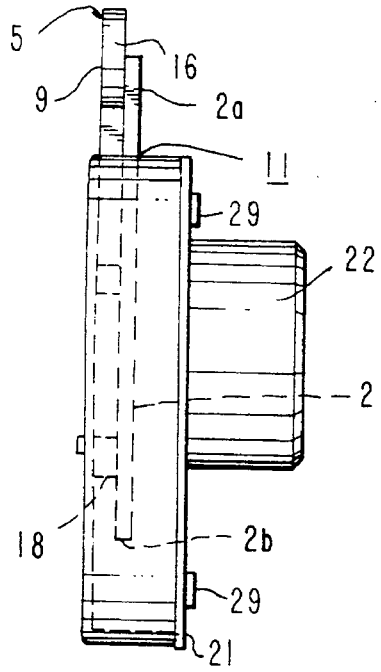
FIG. 5 is a left side view of the hook-bolt lock assembly of the present invention shown in FIG. 1.
Figure 6:
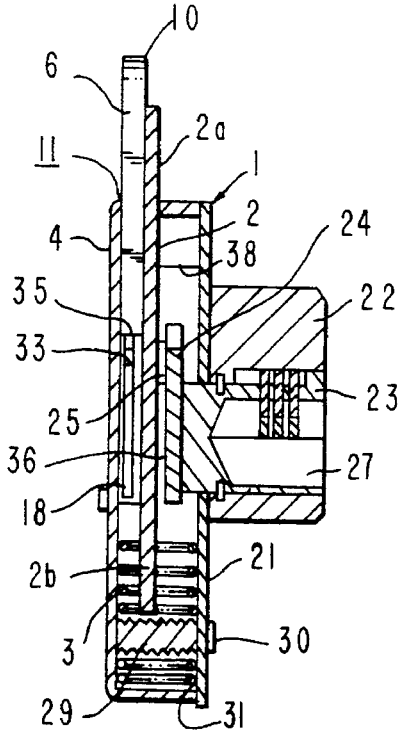
FIG. 6 is a sectional view of the hook-bolt lock assembly of the present invention, taken along the line 6—6 of FIG. 1.

After the door is opened, the key 28 is pulled out of the rotor 23. As a result, as shown in FIG. 2, the movable plate 2 is slidably moved in its projecting direction under the influence of the resilient force exerted by the spring 3, so that each of the hook-bolt plates 5, 6 returns to its initial position in which each of the front-end hook portions 9, 10 is moved outward to a maximum.

When the door 12 is closed, at the last stage in such closing operation of the door 12, the oblique cam portions 16 and 17 of the front-end hook portions 9 and 10 abut against the front edge portions 14*a* and 15*a*, respectively. Consequently, each of the hook-bolt plates 5, 6 are swung inwardly against the resilient force exerted by the leaf spring 18. As soon as the front-end hook portions 9 and 10 of the hook-bolt plates 5 and 6 have passed through the front edge portions 14*a* and 15*a* of the socket member 14 and 15, respectively, the hook-bolt plates 5, 6 are swung outward under the influence of the resilient force exerted by the leaf spring 18, so that their front-end hook portions 9 and 10 are automatically engaged with the socket members 14 and 15, respectively.

In an embodiment of the present invention shown in the drawings, a pair of horizontally arranged mounting holes 37 are provided in the front plate 21 of the casing 1. The front plate 21 of the casing 1 is connected with the casing body through a plurality of spacer sleeves 29 and screws 30. An upper end portion 2*a* of the movable plate 2 projecting upward from the end-surface opening portion 11 of the casing 1 covers root portions of the front-end hook portions 9, 10 of the hook-bolt plates 5, 6 to project these plates 5, 6 from cutting damages.

The spring 3 for biasing the movable plate 2 upwardly is constructed of a compression coil spring which is mounted on a spring-support plate portion 2*b* of the base-end portion of the movable plate 2 in an insertion manner to abut against a lower-end plate 31 of the casing 1. The leaf spring 18 assumes a U-shaped bent form, and has its front-end bent portions 32 and 33 inserted in spring-support notches 34 and 35 of the inner edge portions of the hook-bolt plates 5 and 6, respectively. The operating-arm plate 24 is fixedly mounted on the rotor 23 through screws 36. The casing 1 is provided with a plurality of stopper portions 38 against which a plurality of horizontally-arranged left and right shoulder portions 2*c* of the movable plate 2 abut.

In the hook-bolt assembly of the present invention having the above construction: the swingable operation of the operating-arm plate 24 has the movable plate 2 retracted in the casing 1; and, the pair of horizontally-arranged left and right hook-bolt plates 5, 6 are swung in their disengaging directions relative to the corresponding socket members 14, 15 by the cam projections 19, 20 of the movable plate 2. In the assembly, since the number of the hook-bolt plates is two, the assembly is improved in mechanical strength to withstand an intensive pulling force applied to the door 12 in its locking condition.

Further, when the door 12 is closed, it is possible for the user to close the door 12 by simply pushing the door 12 without inserting the key 28 into the rotor 23 to rotate the operating-arm plate 24, because: the oblique cam surface portions 16, 17 of the front-end hook portions 9, 10 abutting against the socket members 14, 15 mounted on the stationary frame element 13 are oriented outward in arrangement; and, the leaf spring 18 interposed between the hook-bolt plates 5, 6 bias these plates 5, 6 swingably outward; whereby the hook-bolt plates 5, 6 are automatically engaged with the corresponding socket members 14, 15 when the door 12 is closed. Consequently, the hook-bolt lock assembly of the present invention is improved in operability.

Furthermore, in the hook-bolt lock assembly of the present invention, since a means for biasing the pair of horizontally-arranged left and right hook-bolt plates 5, 6 is constructed of the single leaf spring 8, the assembly of the present invention is simple in construction, and, therefore may be assembled at low cost in manufacturing.

What is claimed is:

1. A hook-bolt lock assembly, comprising:

a movable plate (2) which is slidably mounted in a casing (1) and biased toward its projecting direction by a spring (3), said movable plate (2) having an upper portion (2*a*) projecting outwardly from an end surface opening (11) in said casing (1);

a pair of symmetrically-arranged hook-bolt plates (5) and (6) having their base-end portions pivoted to an intermediate portion of a rear-surface plate (4) of said casing (1) through a pair of pivots (7) and (8), respectively;

said hook-bolt plates (5) and (6) having their front-end hook portions (9) and (10) projected outward from said end-surface opening portion (11) of said casing (1), respectively, and adjacent and parallel to said movable plate upper portion (2*a*);

said front-end hook portions (9) and (10) can abut against a pair of socket members (14) and (15) of a stationary frame element (13) when a door (12) is closed, and have their oblique cam surfaces (16) and (17) oriented outward, respectively;

a leaf spring (18) interposed between said hook-bolt plates (5, 6) to swingably bias them outward;

said movable plate (2) being provided with a pair of cam projections (19) and (20) which abut against outer edge surfaces (5*a*) and (6*a*) of said hook-bolt plates (5) and (6), respectively at a location between said pivots (7) and (8) and said front end hook portions (9) and (10) respectively; and a lock unit (22) which is fixedly mounted on a front plate (21) of said casing (1), and has a rear-end portion of its rotor (23) fixed to a base-end portion of an operating-arm plate (24) which has a driving projection (25) of its front-end portion inserted into a slot (26) of said movable plate (2).

2. The hook-bolt lock assembly of claim 1, wherein said casing (1) is attached to a door (12) and said hook plates (5, 6) can engage with a pair of socket members (15, 16) of a stationary frame element (13).

* * * * *